US005791488A

United States Patent [19]

Lee

[11] Patent Number: 5,791,488

[45] Date of Patent: Aug. 11, 1998

[54] CONSUMER PRODUCT TRANSPORT, STORAGE AND DISPLAY SYSTEM

[75] Inventor: Youn Jae Lee, Pleasanton, Calif.

[73] Assignee: Jinwoong, Inc., Seoul, Rep. of Korea

[21] Appl. No.: 895,804

[22] Filed: Jul. 17, 1997

[51] Int. Cl.[6] ..... B65D 33/02

[52] U.S. Cl. ..... 206/768; 190/125; 206/232; 206/459.5; 206/769; 383/111

[58] Field of Search ..... 150/129, 130; 190/125, 127; 206/736, 756, 768, 232, 459.5, 45.29, 321, 769; 220/410; 383/111

[56] References Cited

U.S. PATENT DOCUMENTS

| | | | |
|---|---|---|---|
| 1,639,750 | 8/1927 | Portman . | |
| 1,945,792 | 2/1934 | Stephens . | |
| 2,837,216 | 6/1958 | Paige | 206/736 |
| 3,159,930 | 12/1964 | Allen et al. | 206/459.5 |
| 3,692,072 | 9/1972 | Kohls . | |
| 4,037,778 | 7/1977 | Boyle | 383/111 |
| 4,162,547 | 7/1979 | Jenkins . | |
| 4,353,461 | 10/1982 | Liang . | |
| 4,449,629 | 5/1984 | Barrieau . | |
| 4,513,526 | 4/1985 | Grace et al. . | |
| 4,595,093 | 6/1986 | Eckstein . | |
| 4,648,548 | 3/1987 | Shin | 206/459.5 |
| 4,717,021 | 1/1988 | Ditzig | 206/459.5 |
| 4,809,847 | 3/1989 | Schneider . | |
| 4,907,633 | 3/1990 | Eckstein . | |
| 4,917,160 | 4/1990 | Hart et al. . | |
| 5,024,344 | 6/1991 | Paula . | |
| 5,468,528 | 11/1995 | Schnaars et al. . | |
| 5,469,579 | 11/1995 | Tremblay et al. . | |
| 5,490,619 | 2/1996 | Boyar . | |
| 5,507,578 | 4/1996 | Ozeri et al. . | |
| 5,533,809 | 7/1996 | Gorman . | |
| 5,706,953 | 1/1998 | Polvere | 206/736 |

*Primary Examiner*—Jimmy G. Foster

*Attorney, Agent, or Firm*—Michael J. Hughes; Larry B. Guernsey

[57] ABSTRACT

A system for transporting, storing and displaying consumer products (10) includes a shipping container (40) having a plurality of sides (42), of which at least one of the plurality of sides is a detachable display panel (32). The shipping container (40) is sized to hold one or more consumer items (44). A flexible display and carrying bag (12) has at least one transparent display pouch (30) which is configured to hold the display panel (32). The display bag (12) further includes a resealable opener (22), such as a zipper which can be opened to allow insertion of the shipping container (40) with the display panel (32) removed into the display bag (12) to provide internal structural support to the display bag (12). The display bag (12) can then be easily stacked for storage or displayed on a retail store's selling floor, thus providing easily visible display information (34) and providing protection for the display panel (32) from in-store handling, as well as consumer access to the product (44) for inspection. Also disclosed is a method of transporting, storing and displaying consumer products (44) by means of the system (10).

21 Claims, 3 Drawing Sheets

CONSUMER PRODUCT TRANSPORT, STORAGE AND DISPLAY SYSTEM

TECHNICAL FIELD

The present invention relates generally to an improved shipping and display container for consumer items and, more particularly, to containers which can be used for both retail display of consumer items and as a carrying bag for the consumer items themselves.

BACKGROUND ART

The costs of shipping and displaying consumer items in retail stores is a significant portion of the overall costs of merchandizing such products. Semi-rigid rectangular solid shapes have a big advantage during shipping, as they fit well into larger containers, and stack in cargo holds of vehicles with little wasted space. Cardboard cartons are therefore often used for such shipping purposes. It is well known in the art that cardboard cartons can be printed with display information which can attract consumers attention with colorful graphics. It is often desirable to allow consumer access to the item enclosed in the protective packaging, especially for such items as shoes where proper fit is important. Consumers may wish to inspect sporting goods in particular for details which make a particular model or style appropriate for a special purpose. In these cases it would be very desirable to have a resealable enclosure which can be opened for inspection of contents, and then re-closed to maintain the integrity of the items. Cardboard containers which are sturdy enough to withstand damage in shipping are usually not resealable, and once opened, present an undesirable appearance. Consumers who are faced with a previously opened cardboard container may suspect that there may be components missing from the product, or that there was damage in shipment. Often such goods go unsold and must be returned to the manufacturer as defective, even though no such real defect exists.

The display information is often included on separate cards which can be set up to draw consumer attention. These separate displays are thus isolated from the incidental damage which may occur to shipping containers which are subjected to the rough-and-tumble handling which may occur in retail stores. The contents of the cartons may therefore not be as obvious since the main display information has been separated from the shipping containers. There may be an increased chance of mislabeling of the contents, with attendant costs. It is thus advantageous to have display information included on the shipping containers, and to provide a means for protecting this display information from damage during handling in the store environment.

For some bulky items, and especially for sporting goods, it would be desirable to have a means for easily carrying these items. Camping equipment, which must be loaded for transportation in a vehicle or even carried for distances by hand, would be much more easily manipulated if the items were in a container designed for carrying. Items such as shoes could also be attractively marketed by including them in a handbag which would accompany the products.

Tote-bags are well-known in the art, however, such bags generally have the disadvantage that they are made from cloth, which is generally not rigid. Therefore, they typically do not maintain a shape that is easily stackable for storage, and they are not convenient to arrange in displays. Several previously known bags have been made with internal frameworks to give them a desired shape, but these frameworks were generally for display purposes, and were removed before sale to consumers. Some others, such as the well-known backpack frame, are an integral part of the overall consumer item, but are not designed to hold display information to aid in merchandising.

An internal support structure which is optionally removable after sale, also has advantages. It may reduce weight and bulk, which can be important for items which will be carried by hand or used for backpacking trips.

U.S. Pat. No. 5,507,578 to Ozeri sets forth the use of an inflatable device for giving proper shape to a display bag. The Ozeri patent shows an internal support structure, but it is of little use to the purchaser of the item, and is probably used only on a display sample.

U.S. Pat. No. 5,024,344 to Paula discloses a reusable flexible bag with a foldable support structure. Although this does supply a means for supporting a bag in an open position, it appears not to be easily adaptable to showing display information and would probably not be very useful for displaying a number of consumer items.

Display information can be made visible within shipping containers by use of transparent windows, which are well known in the art. U.S. Pat. No. 1,945,792 to Stephens shows a windowed merchandise container, and U.S. Pat. No. 1,639,750 to Portman shows a merchandise display box, both of which contain display windows through which merchandise can be viewed. However, although windowed boxed may be useful in a display context, they are typically too fragile to be used in shipping.

U.S. Pat. No. 4,353,461 to Liang discloses a merchandise packaging system by which a merchandise card can be reverse folded into a gift box. This does allow for both display and purchaser usage, but appears to provide no resealable feature which would allow consumer inspection of all aspects of the contents.

U.S. Pat. No. 4,809,847 to Schneider shows a shipping and display container for a number of stacked boxes. This invention can act as a shipping container as well as be used to display small consumer items, but again, this would be used by the merchant and would not be useful to the purchaser.

Thus there is a need for a packaging system which would provide sturdy protection of products during shipping, readily recognizable identification of package contents to minimize shipping mistakes, an attractive display information panel to aid in merchandizing which can be protected from rough handling in a store environment, a resealable means of allowing customer inspection of the product, and a handy means of carrying the consumer item, both for ease of display by the merchant and for manipulation by the purchaser after sale.

DISCLOSURE OF INVENTION

Accordingly, it is an object of the present invention to provide a shipping container which affords sturdy protection to its contents.

Another object of the present invention is to provide a container which has easily recognizable display information to avoid mistakes in packing and shipping.

Yet another object of the current invention is to provide a means of showing display information in a manner which protects the display information from damage during handling in a retail store.

Still another object is to provide a display container which is resealable to allow consumer inspection of products.

A further object is to provide a resealable container which has internal support to allow easy stacking for in-store storage, and also easy arrangement for display.

A yet further object is to provide an internal support structure which is removable to reduce weight and bulk, after sale, if desired.

And a still further object is to provide a container which is easily carried by either the merchant or the eventual purchaser.

The present invention is directed to a system of packaging for shipment, storage and display purposes, which can also be used by the purchaser to easily transport the consumer item. Briefly, one preferred embodiment of the present invention is a packaging system which includes a shipping carton having one removable side which is printed with display information. The carton contains the consumer item as well as a flexible display bag which may be made of cloth. The display bag contains a resealable opener such as a zipper, and has attached carrying handles or straps. The bag is of an appropriate size that the shipping carton can fit inside the display bag to give the bag internal support and rigidity. One side of the display bag has a transparent pouch. The removable side of the carton which contains the display information, once detached from the carton, can be inserted into the transparent pouch of the display bag for merchandizing purposes. Once purchased, the carton can be removed by the consumer or retained to continue providing support for the bag. The display panel can also be disposed of, and the pouch can be used for carrying personal items such as maps, etc.

The described versions of the present invention have many advantages which address the above-mentioned objects. One such advantage is that the shipping container is sturdy enough to provide good protection to the package contents during transportation to retail stores.

Another advantage is that the shipping container has a removable side or panel which contains display information to minimize mistakes in packaging and handling.

A further advantage is that the present invention provides a display bag which additionally has a transparent display pouch into which the display panel can be inserted to provide protection from handling for the display information.

Yet another advantage is that the display bag is openable and resealable to allow customers to inspect the products prior to purchase.

A still further advantage of the present invention is that the resealable display bag is provided with internal structural support by means of insertion of the shipping container, thus allowing easy stacking and in-store display.

An additional advantage of the present invention is that the display bag is provided with carrying straps or handles, which allow both merchants and purchasers to easily transport the bag and its contents.

A further additional advantage is that after purchase, the display panel can be removed and the transparent display pouch can be used by the purchaser for holding personal items, such as maps.

A yet further advantage is that the internal support structure is removable after sale to reduce weight and bulk, if desired.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
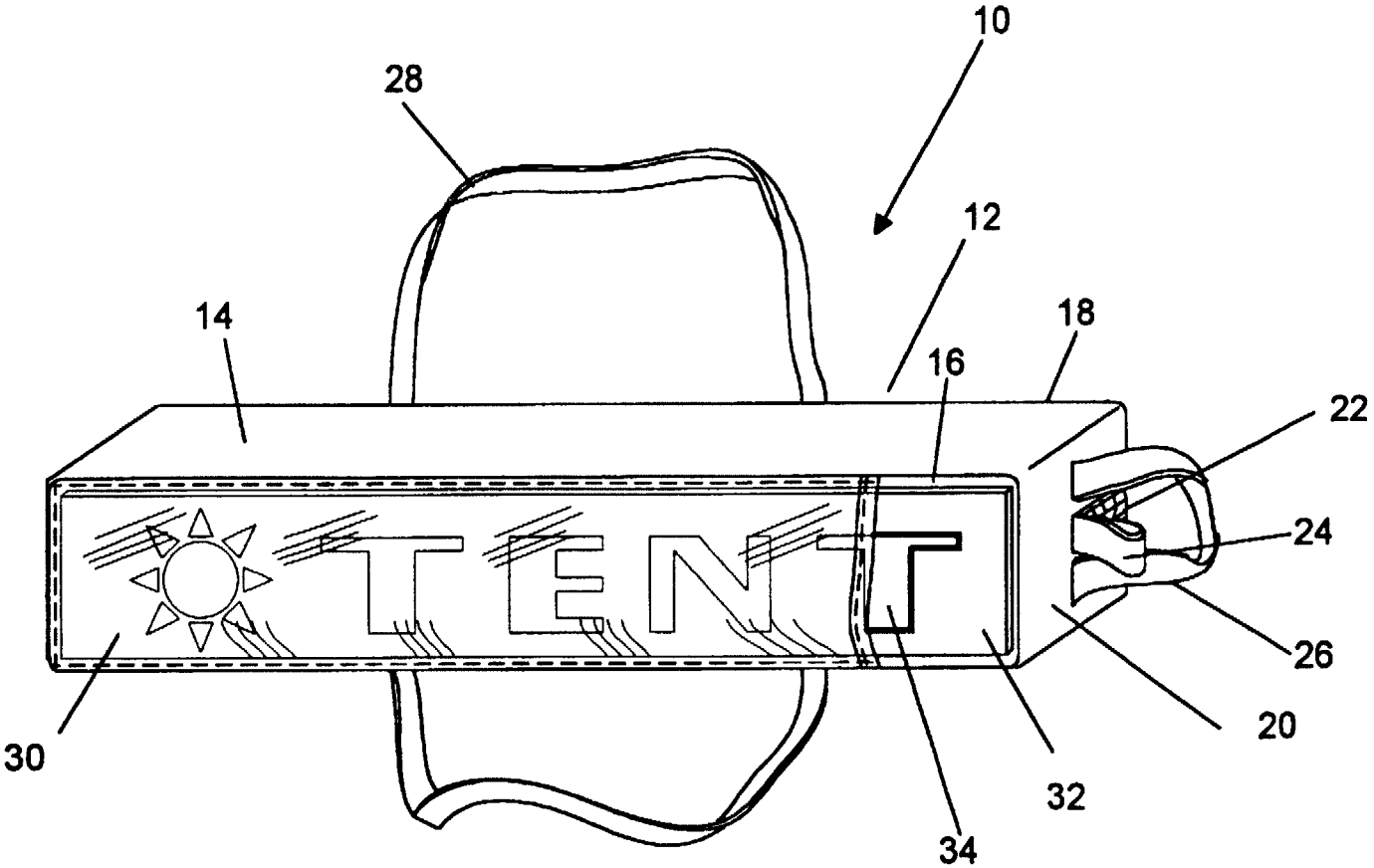
FIG. 1 is a bottom perspective view of a display bag containing a display pouch into which has been inserted a display information panel which has been detached from a shipping container.

A preferred embodiment of the present invention is the consumer product transport, storage and display system. As illustrated in the various drawings herein, and particularly in view of FIG. 1, a form of this preferred embodiment of the inventive device is depicted by the general reference character 10. It should be understood that although the consumer product used for illustration is a tent, the transport and display system is easily adaptable to a variety of consumer items, including shoes, and many types of sporting goods, among many others.

FIG. 1 illustrates a bottom view of a consumer product transport, storage and display system 10, as it would be used in a retail store setting. A display and carrying bag 12 (for convenience sake, to be referred to as "bag 12") has long sides 14, a bag bottom 16, a bag top 18, and bag ends 20 and can be made of any flexible or foldable material including cloth, either synthetic or natural, and various types of plastics, among other such materials. In this embodiment, the preferred material is nylon. The bag top 18 has a resealable opener 22, which in this embodiment is a zipper, although it should be understood that a number of different mechanisms may be used such as Velcro/™, a resealable adhesive strip, snaps, buttons or any number of hook-and-eye fasteners and the like. This version of the preferred embodiment also has an optional gripping loop 24, which can be grasped to hold the bag 12 while the opener 22 is manipulated. The opener 22 can also be of several types of zipper, such as a single-tab type which draws from one end 20 to the other, or it can have two tabs which can be drawn to meet in the center of the top 18. Also there may be a second optional gripping loop at the opposite bag end 20. Either or both of the bag ends 20 may also have an optional end strap 26. Carrying handles or straps 28 are attached to the bag top 18 or sides 14 for easy transport during store display set-up or by the consumer after purchase.

The bag bottom 16 has a transparent display pouch 30 attached by one of several methods such as gluing, heat or ultrasonic spot welding or sewing, etc. Between the transparent pouch 30 layer and the bag bottom 16 a display card or panel 32 is inserted. The display panel 32, in this version of the preferred embodiment, is a pre-printed side 42 of the shipping container 40 (see FIG. 2) which has been detached. The display panel 32 contains display information 34 such as item name, brand name, use instructions, or graphics depicting happy consumers enjoying the contained product. The transparent pouch 30 permits easy viewing of the display information 34 while protecting the display panel 32 from damage during in-store handling.

Figure 2:
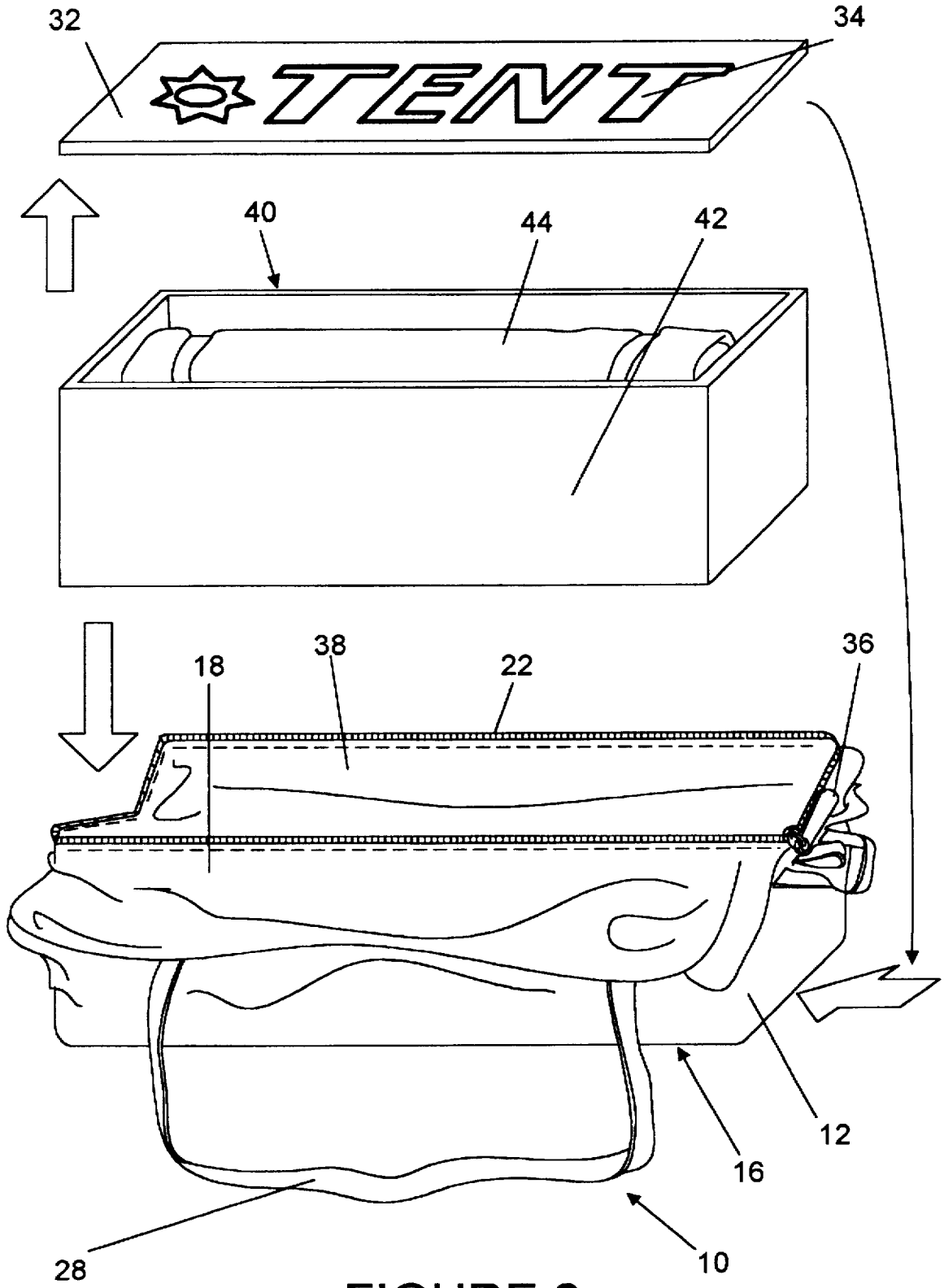
FIG. 2 is a side perspective view of the shipping and display system, which shows the display bag, the shipping container, which is to be inserted into the display bag, and the display information panel, which has been removed from the shipping container, to be inserted into the display pouch of the display bag; and, FIG. 3 is a bottom perspective view of the display bag and a side perspective view of the shipping container, from which the display information panel has been removed and which is to be inserted into the transparent display pouch of the display bag.

FIG. 2 illustrates the bag 12 in which the zipper pull tab 36 has been drawn to one bag end 20 to unzip the opener 22 and open the bag mouth 38. The shipping container 40 includes a number of sides 42, one of which (in this case, the top) is printed with display information 34 to make the display panel 32. It is detached from the shipping container 40. A typical consumer item 44, such as a tent, can be seen in the interior of the shipping container 40. During shipment, the display bag 12 is folded and placed inside the shipping container 40, which includes the display panel 32 as part of its structure. When the shipping container 40 reaches the retail store, the display panel 32 is detached from the shipping container 40, and the display bag 12 is removed from the interior of the shipping container 40. The display bag 12 is unfolded, the opener 22 is drawn to open the bag mouth 38, and the shipping container 40 is inserted into the display bag mouth 38. The shipping container 40 and the display bag 12 are configured so that the display bag 12 fits snugly around the shipping container 40, which acts as an internal framework for the display bag 12. The display bag 12 is then resealed to retain the consumer item 44. The display panel 32 is then inserted into the display pouch 30 of the display bag 12 and the entire display system 10 can be transported by grasping the carrying straps 28 for storage or display in the store.

Figure 3:
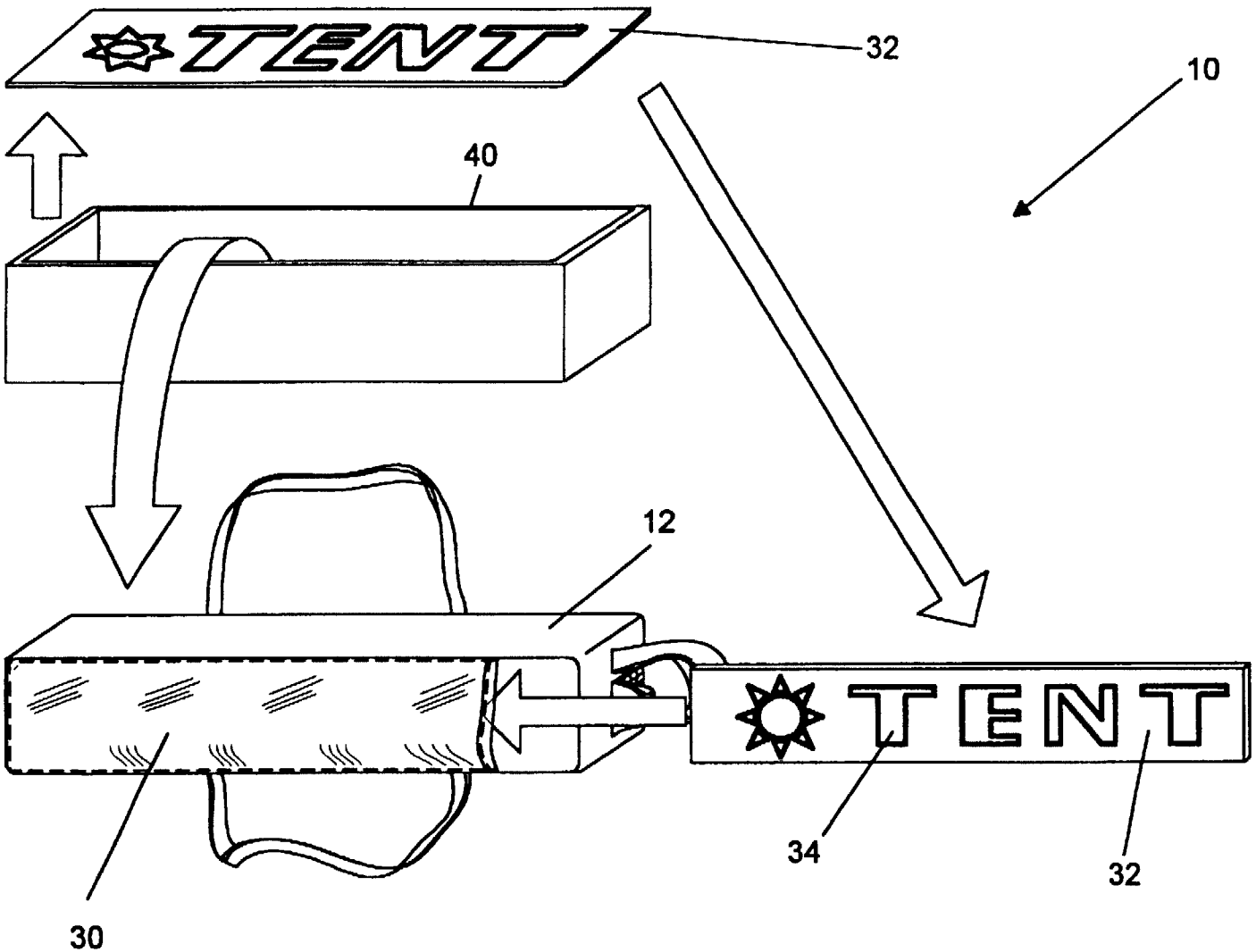

FIG. 3 illustrates the removal of the display panel 32 from the shipping container 40 and its insertion into the display pouch 30 of the display bag 12. After sale, the purchaser can remove the display panel 32 from the display pouch 30, and can use the display pouch 30 for carrying personal items such as a map.

It should be understood that although the preferred embodiment shows the display pouch 30 being attached to the bottom 16 of the display bag 12 with carrying handles 28 attached to the sides 14 or top 18, it is possible that the display pouch 30 may be attached to one or more of the sides 14. It is also possible that the display bag 12 is not contained within the shipping container 40 during shipment, but that one or more of them may be grouped in a separate package.

Also it is possible that the transparent pouch 30 may be replaced by a window of transparent material which makes up an integral side 14 or bottom 30 of the display bag 12.

There are a number of ways that the display panel 32 can be detached from the main shipping container 40. It could be cut off with a knife along a printed dotted line, or along a perforation, or there could be a pull strip of fibrous material that opens a groove around the perimeter of the container 40 so that the display panel 32 is detached.

In addition to the above mentioned examples, various other modifications and alterations of the inventive transport and display system 10 may be made without departing from the invention. Accordingly, the above disclosure is not to be considered as limiting and the appended claims are to be interpreted as encompassing the true spirit and the entire scope of the invention.

INDUSTRIAL APPLICABILITY

The present consumer product transportation, storage and display system 10 is well suited for use in merchandising consumer goods, especially sporting goods, and is additionally useful to the purchaser as a convenient carrying device.

A substantial portion of the cost of a consumer item is involved with the shipping and merchandising of the item after it has been manufactured. Consumer goods, in a free market system, must compete for the consumer's attention and an attractive display of the goods is very important to the eventual success of the items, and perhaps the ultimate success of the manufacturer of the goods. It is important at several steps that the item be securely shipped from the manufacturer and properly displayed at the retail store. The present system 10 has many advantages which make these important steps more successful.

Much expense is incurred when goods are mistakenly labeled and shipped to an incorrect destination. Typically, shipping cartons are generally made of blank cardboard. Information identifying the contents is usually stamped on the carton. If there is to be any attractive display information provided to the store, it may be in the form of promotional materials which are usually sent in a separate package which accompanies the shipment. If a package is mislabeled, it can cause expense in sending it back and obtaining a replacement, as well as delays in delivery, and customer disappointment and frustration.

In the present system 10, identifying information 34 is prominently displayed on one side 14 of the shipping carton 40. The contents 44 are thus immediately recognizable, which can lead to reduction in mistakes made both in packaging and in shipping the goods to the retail store. Warehouse workers are less likely to send a wrong package if it is clearly identified with a color picture of the contents than if it is marked with a stamp in some obscure location. Workers receiving shipments can also immediately recognize if the incoming goods conform to the order. This naturally leads to a reduction in costs, which can be substantial in large volume businesses.

Once the shipment arrives in the retail store, the shipping container 40 is opened, the display bag 12 is removed and unfolded, and the display panel 32 is detached from the shipping container 40. The display bag 12 is opened, and the shipping container 40 is inserted into the display bag 12. The bag 12 is resealed to protect the contained consumer item 44, and the display panel 32 is inserted into the transparent pouch 30 of the display bag 12. The shipping container 40 acts as an internal support structure for the display bag 12, which can then easily be transported by the carrying handles 28 and conveniently stacked for storage or displayed on the store's sales floor. The transparent pouch 30 allows easy viewing of the display information 34 while protecting the display panel 32 from damage due to rough handling by customers and store personnel. The display information 34 thus maintains an attractive appearance which can give these goods a competitive edge over other, less well-displayed goods.

The resealable nature of the display bag 12 also gives a great advantage, as customers can inspect the details of the contained goods 44 without having to tear open a carton, which may render the carton unusable for future sale. Especially for items such as shoes, where individual fit is important, or certain types of sporting goods, where customers may wish to inspect details of construction, customer satisfaction can be expected to increase when they are allowed to inspect merchandise before purchase. This can produce fewer returns for defective or unsuitable items and perhaps enhance store reputation and increase repeat business.

The display bag 12 itself can be an attractive item, promoted as a "bonus" received with the purchase of the main item 44, in a similar way that some department stores offer tote bags to carry purchases. For some sporting goods, this becomes especially advantageous, as the purchaser often needs to transport these goods, such as tents, to load in vehicles, or carry by hand for some distances. The inclusion of a convenient carrying bag 12 can be a selling point which may influence a customer's choice of manufacturer.

For use with certain sporting goods, the transparent pouch 30 can also be useful to the purchaser, who can remove the display panel 32 and use the pouch 30 for storage of personal items such as maps, or camping accessories. This also may be a selling point which could attract an additional customer.

The present consumer product transport, storage and display system 10 can thus save return costs of mistakenly shipped, defective, or unsatisfactory merchandise, can increase customer satisfaction and good-will, increase competitiveness of the manufacturer's goods in the marketplace and provide useful and attractive features for the purchaser. For the above, and other reasons, it is expected that the present invention will have widespread industrial applicability. Therefore, it is expected that the commercial utility of the present invention will be extensive and long lasting.

What is claimed is:

1. A system for transporting, storing and displaying consumer products, comprising:

a shipping container having a plurality of sides, at least one of said plurality of sides being a detachable display panel, said shipping container being configured to hold one or more consumer products;

a flexible display bag having at least one transparent display pouch configured to hold said display panel;

said display bag further including a resealable opening means; and said display bag being further configured so that said shipping container with said display panel removed can be inserted within said display bag to provide internal structural support to said display bag.

2. A system for transporting, storing and displaying consumer products, as in claim 1 wherein:

said display bag is composed of flexible material such that said bag can be folded and inserted into said shipping container before said container is shipped.

3. A system for transporting, storing and displaying consumer products, as in claim 1 wherein:

said resealable opening means is a zipper.

4. A system for transporting, storing and displaying consumer products, as in claim 1 wherein:

said resealable opening means is a hook and eye fastener.

5. A system for transporting, storing and displaying consumer products, as in claim 4 wherein:

said hook and eye fastener is a Velcro/™ strip.

6. A system for transporting, storing and displaying consumer products, as in claim 1 wherein:

said resealable opening means is an adhesive strip.

7. A system for transporting, storing and displaying consumer products, as in claim 1 wherein said system further comprises:

one or more carrying straps attached to said display bag.

8. A system for transporting, storing and displaying consumer products, as in claim 2 wherein:

said flexible bag material is plastic.

9. A system for transporting, storing and displaying consumer products, as in claim 2 wherein:

said flexible bag material is cloth.

10. The system of transporting, storing and displaying consumer products of claim 9 wherein:

said cloth is nylon.

11. A method of transporting, storing and displaying consumer products comprising the steps of:

providing a shipping container having a plurality of sides, at least one of said plurality of sides being a detachable display panel, said shipping container being configured to hold one or more consumer products;

providing a flexible display bag having at least one transparent display pouch configured to hold said display panel, said display bag further including a resealable opening means, said display bag being further configured so that said shipping container with said display panel removed can be inserted within said display bag to provide internal structural support to said display bag;

shipping said shipping container containing said consumer items;

removing said detachable display panel from said shipping container;

opening said resealable opening means in said display bag;

inserting said shipping container from which said display panel has been detached, into said display bag, to provide internal structural support for said display bag;

inserting said display panel into at least one said pouch of said display bag; and displaying said display bag on a retail store show floor.

12. The method of transporting, storing and displaying consumer products of claim 11 further comprising the step of:

storing said display panel until needed, before displaying said display bag on a retail store show floor.

13. The method of transporting, storing and displaying consumer products of claim 11 wherein:

said display bag is composed of flexible material such that said bag can be folded and inserted into said shipping container before said container is shipped.

14. The method of transporting, storing and displaying consumer products of claim 11 wherein:

said resealable opening means is a zipper.

15. The method of transporting, storing and displaying consumer products of claim 11 wherein:

said resealable opening means is a hook and eye fastener.

16. The method of transporting, storing and displaying consumer products of claim 15 wherein:

said hook and eye fastener is a Velcro/™ strip.

17. The method of transporting, storing and displaying consumer products of claim 11 wherein:

said resealable opening means is an adhesive strip.

18. The method of transporting, storing and displaying consumer products of claim 11 wherein said system further comprises:

one or more carrying straps attached to said display bag.

19. The method of transporting, storing and displaying consumer products of claim 13 wherein:

said flexible bag material is plastic.

20. The method of transporting, storing and displaying consumer products of claim 13 wherein:

said flexible bag material is cloth.

21. The method of transporting, storing and displaying consumer products of claim 13 wherein:

said cloth is nylon.

* * * * *